US012693061B2

(12) United States Patent
Davidson

(10) Patent No.: US 12,693,061 B2
(45) Date of Patent: Jul. 28, 2026

(54) PORTABLE WATER-COOLED AIR CONDITIONER WITH A DEDICATED STORAGE COMPARTMENT FOR A HOSE KIT

(71) Applicant: Matthew Philip Davidson, Miami Gardens, FL (US)

(72) Inventor: Matthew Philip Davidson, Miami Gardens, FL (US)

( * ) Notice: Subject to any disclaimer, the term of this patent is extended or adjusted under 35 U.S.C. 154(b) by 98 days.

(21) Appl. No.: 18/779,975

(22) Filed: Jul. 22, 2024

(65) Prior Publication Data

US 2026/0022882 A1 Jan. 22, 2026

(51) Int. Cl.
*F25D 11/00* (2006.01)
*F25D 23/02* (2006.01)
*F25D 23/06* (2006.01)

(52) U.S. Cl.
CPC ..... *F25D 11/00* (2013.01); *F25D 23/02* (2013.01); *F25D 23/062* (2013.01)

(58) Field of Classification Search
CPC ..... F25D 11/00; F25D 23/02; F25D 23/062; F25D 25/04; B65D 25/04
USPC .... 312/401, 236, 327, 328, 290, 209, 249.8; 280/288.4
See application file for complete search history.

(56) References Cited

U.S. PATENT DOCUMENTS 2,545,089 A * 3/1951 Ladewig ..... A61M 3/0266 D24/117
2,750,246 A * 6/1956 Fuerst ..... A47B 61/00 312/213
3,412,614 A * 11/1968 Mazurkevics ..... G01R 1/02 73/431
3,573,879 A * 4/1971 Bergkamp ..... A47L 13/51 280/47.35
4,566,443 A * 1/1986 Bucher ..... A61H 33/60 D24/201
4,989,291 A * 2/1991 Parent ..... A47L 9/0063 15/339
5,022,548 A * 6/1991 Stakis ..... B65F 1/006 220/909
5,113,546 A * 5/1992 Parent ..... B25H 3/00 312/249.8
5,306,028 A * 4/1994 Pike ..... G07F 9/06 280/47.35

(Continued)

FOREIGN PATENT DOCUMENTS

CN 209877247 U * 12/2019
CN 115540073 A * 12/2022 ..... F24F 13/20
JP H06241496 * 8/1994

OTHER PUBLICATIONS

CN209877247 English translation (Year: 2019).*
CN-115540073-A English translation (Year: 2022).*
JPH06241496 English translation (Year: 1994).*

*Primary Examiner* — Janet M Wilkens
(74) *Attorney, Agent, or Firm* — Dunlap Bennett & Ludwig PLLC

(57) ABSTRACT

A portable water-cooled air conditioner unit providing a dedicated storage compartment for the hose kit. The body of the portable water-cooled air condition unit having an internal compartment dimensioned and shaped to retrievable house a uniquely shaped and sized hose kit in a wound condition. The internal compartment may have a transition shelf between an upper and lower portion to facilitate storage of the hose kit.

4 Claims, 3 Drawing Sheets

(56) References Cited

U.S. PATENT DOCUMENTS

| | | | | |
|---|---|---|---|---|
| 7,438,084 | B2 * | 10/2008 | Trettin | B65H 75/42<br>137/355.16 |
| 7,921,683 | B2 * | 4/2011 | Largay, Jr. | E05B 65/52<br>70/164 |
| 2009/0200787 | A1 * | 8/2009 | Schatz | B60S 3/00<br>280/830 |
| 2015/0060463 | A1 * | 3/2015 | Ragha | B65D 43/161<br>220/554 |

* cited by examiner

PORTABLE WATER-COOLED AIR CONDITIONER WITH A DEDICATED STORAGE COMPARTMENT FOR A HOSE KIT

BACKGROUND OF THE INVENTION

The present invention relates to water-cooled air conditioners and, more particularly, to a portable water-cooled air conditioner providing a dedicated storage compartment for a hose kit.

There are many types of air conditioning systems, though regardless of their type, air conditioning systems need a readily available supply of water. Accordingly, a water conduit or hose comes in handy to establish such a fluid connection between a portable air condition unit and a water source having a hose spigot or tap.

Unfortunately, currently there is no current integrated storage compartment in a water-cooled portable air conditioner. A likely reason for this is that water-cooled portable air conditioners tend to use uniquely shaped and sized hose kits. These hose kits include various hose lengths from 25' to 40' and are made of high pressure rubberized hoses with quick connect fittings. However, hose kits may become damaged, tangled, misplaced, may be difficult to access, and may be deleteriously exposed to heat and environmental elements if the hose kit is not housed in a protective enclosure. Furthermore, hose kits can lead to a tripping hazard if they are left out. All these issues can lead to frustration and inefficiency for users. Additionally, traditional storage methods for water-cooled air condition hose kits do not adequately address the need for easy accessibility and organization of such hose kits, resulting in a less-than-ideal user experience.

As can be seen, there is a need for a portable water-cooled air conditioner providing a dedicated storage compartment for the hose kit, thereby solving the inconvenience and messiness plaguing current approaches to storing hose kits for water-cooled portable air conditioners.

SUMMARY OF THE INVENTION

Without dedicated storage, the required hose kits for portable water-cooled air-conditioners may become damaged, tangled, misplaced, difficult to access, and exposed to heat and environmental elements. The present invention offers a dedicated storage solution specifically tailored to the unique needs of portable water-cooled air conditioner hose kits, ensuring effortless organization, accessibility and preventing damage, which surpasses the general storage options available and enhances user experience with unparalleled convenience and efficiency.

The invention improves traditional storage methods by providing a designated and tailored storage solution specifically designed to accommodate the unique shape and size of portable water-cooled air conditioner hose kits. By integrating a dedicated pocket into the design of the water-cooled air conditioner, the present invention ensures that hoses are stored neatly and securely when not in use, preventing damage, tangling, misplacement, and difficulty in access. This improvement promotes user convenience, efficiency, and a tidier living space, ultimately enhancing the overall user experience with portable water-cooled air conditioners.

The present invention, embodying a pocket for storing hose kits in portable water-cooled air conditioners, provides a designated space to neatly organize and contain the hoses when they are not in use. By integrating this pocket into the design of the portable water-cooled air conditioner, users can easily access and stow away the hoses, reducing clutter and eliminating the need to search for or untangle them when needed. This solution promotes convenience, efficiency, and a tidier living space for users of portable water-cooled air conditioners.

In one aspect of the present invention, a portable water-cooled air condition unit provides an internal compartment dimensioned and shaped to retrievable house a hose kit configured to fluidly associate with the portable water-cooled air condition unit.

In another aspect of the present invention, the portable water-cooled air condition unit further provides a body defining an enclosure for the internal compartment; and a lid pivotably connected to the body to move between an open condition and a closed condition preventing access to the internal compartment, wherein the internal compartment has an upper portion communicating with an opening associated with lid in the closed condition; a lower portion having a lower depth approximately two-thirds that of an upper depth of the upper portion; and a transition shelf interconnecting rear walls of the upper and lower portions, wherein the rear walls define a rearmost barrier of the upper and lower portions and so the upper and lower depths, respectively, and wherein the transition shelf is configured to be disposed underneath an end portion of the hose kit in a wound condition housed in the internal compartment, wherein the transition shelf has a transition angle relative the rear wall of the upper portion, wherein the transition angle is between one hundred and twenty degrees and one hundred and fifty degrees, wherein a midpoint of the transition shelf is disposed between forty and sixty percent of a distance defined by said opening and a lowest portion of the lower portion, and wherein the body defines a space physically separated from the internal compartment, wherein the space houses one or more pump components.

These and other features, aspects and advantages of the present invention will become better understood with reference to the following drawings, description and claims.

DETAILED DESCRIPTION OF THE INVENTION

Figure 1:
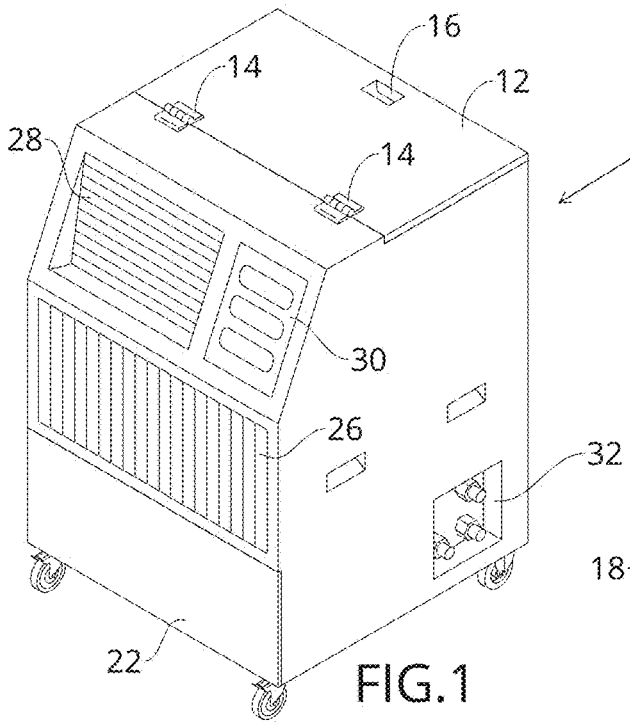
FIG. 1 is a front perspective view of an exemplary embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a portable water-cooled air conditioner providing a dedicated storage compartment for the hose kit.

Referring to FIGS. 1 through 6, the disclosure provides a portable water-cooled air conditioner 100 having a conditioner box or body 10 that defines a dedicated hose compartment 18, wherein the body 10 is dimensioned and shaped to enclose the necessary components for a water-cooled air conditioner as well as the dedicated hose compartment 18.

Along an upper surface of the body 10, a compartment lid 12 may be pivotably attached thereto. The pivotable attachment 14 may be a hinge or any other connection mechanism that facilitates the compartment lid 12 moving between a closed condition and an open condition providing access to the dedicated hose compartment 18. The compartment lid 12 may have a handle 16 to facilitate such movement. In the closed condition, the compartment lid 12 protects the dedicated hose compartment 18, and a hose kit 20 it houses, from dust, debris, and potential damage.

The body 10 is the component that serves as the main structure of the water-cooled portable air conditioner 100 as well as houses all the internal components required for the air conditioning functionality, such as but not limited to nor necessarily including a compressor, a condenser, a fan, and operative controls. Additionally, the body 10 incorporates the specially designed storage pocket or dedicated hose compartment 18.

The hose compartment 18 is a designated space within the body 10 of the portable water-cooled air conditioner 100 specifically designed to securely store the hose kit 20 in a wound condition and when not in use. This hose compartment 18 is strategically located within the top of the housing to optimize space efficiency and ensure ease of access when needed.

The body 10 also provides, along its exterior, a control panel 30 for controlling the portable water-cooled air conditioner 100, a supply air grill 28, a return air grill 26, fluid and or power ports or hookups 32, a cord hook 34, and a panel door 22. The panel door 22 is moveable between a closed position and an open position providing access to an electrical and/or pump equipment area 24 that may house the electrical and pump equipment that operatively associates with the control panel 30, the supply air grill 28, the return air grill 26, and the fluid and or power ports or hookups 32 for making the portable water-cooled air conditioner 100 operable for lowering the temperature of the surrounding air. Together, these components form a cohesive system within the portable water-cooled air conditioner 100.

The body 10 provides the structural support and accommodation for all internal components, while the hose compartment 18, along with its hinged lid 12, offers a practical solution for conveniently storing the hose kit 20 when not in use, enhancing the overall functionality and user experience of the device. Accordingly, housing/body 10 needs to be designed to accommodate all internal components while also incorporating the hose compartment 18. The body May 10 be made from various metallic or plasticized materials and manufactured to ensure precision and durability to support the weight of the internal components and provide adequate protection.

The hose compartment 18 may be integrated into the body 10 during the manufacturing process. Hose compartment 18 may be constructed out of metallic or plasticized material, such as but not limited to stainless steel, while the body 10 is assembled in the form of a condition box. The hinged lid 12 may be manufactured separately from the housing/body 10 though likewise fabricated from plasticized or metallic materials. Furthermore, the pivotable mechanisms 14 may be installed on the lid 12 with bolts to secure to the top portion of the hose compartment 18.

Figure 2:
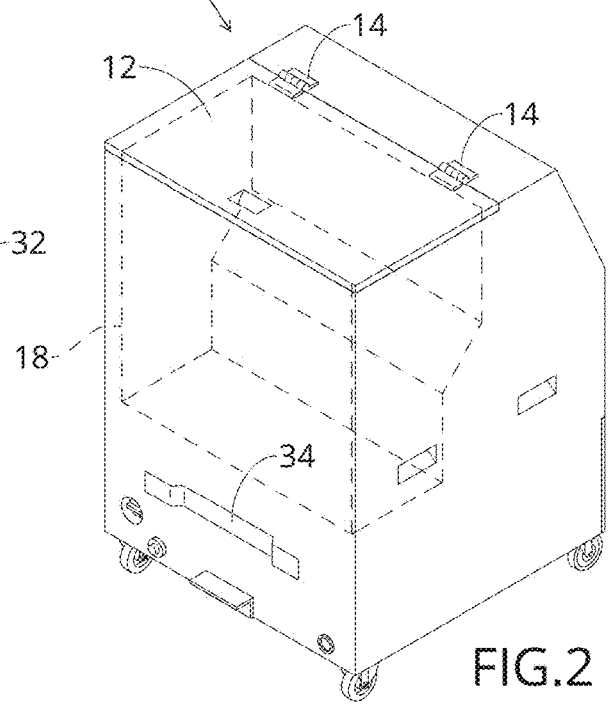
FIG. 2 is a rear perspective view of an exemplary embodiment of the present invention.
Figure 3:
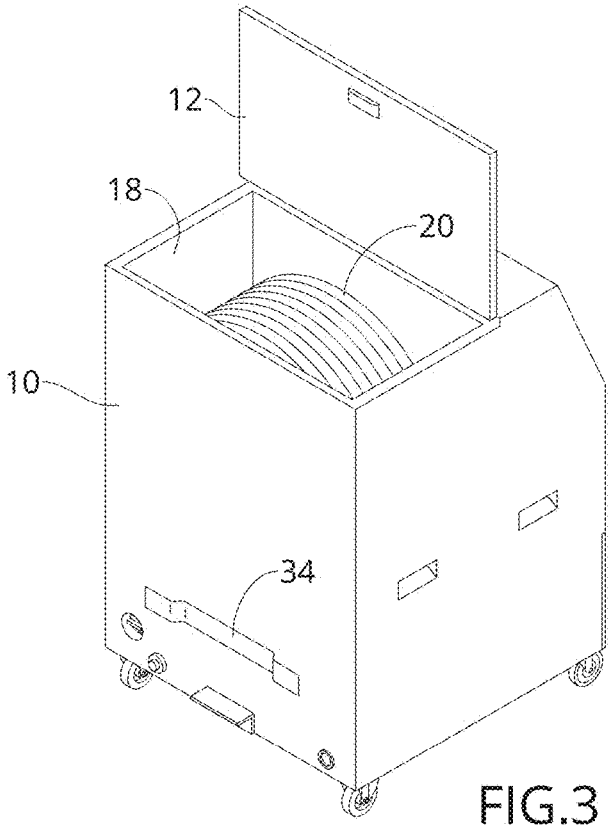
FIG. 3 is a rear perspective view of an exemplary embodiment of the present invention, with the lid raised.
Figure 4:
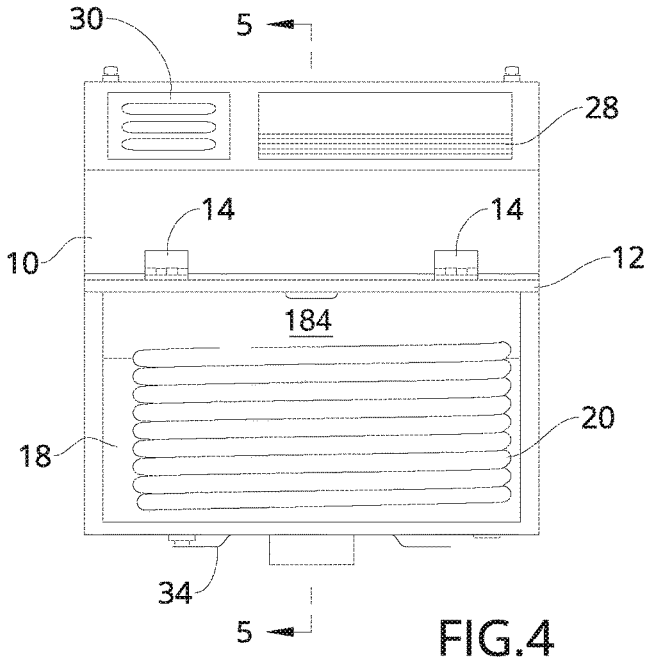
FIG. 4 is a top perspective view of an exemplary embodiment of the present invention, with the lid raised.
Figure 5:
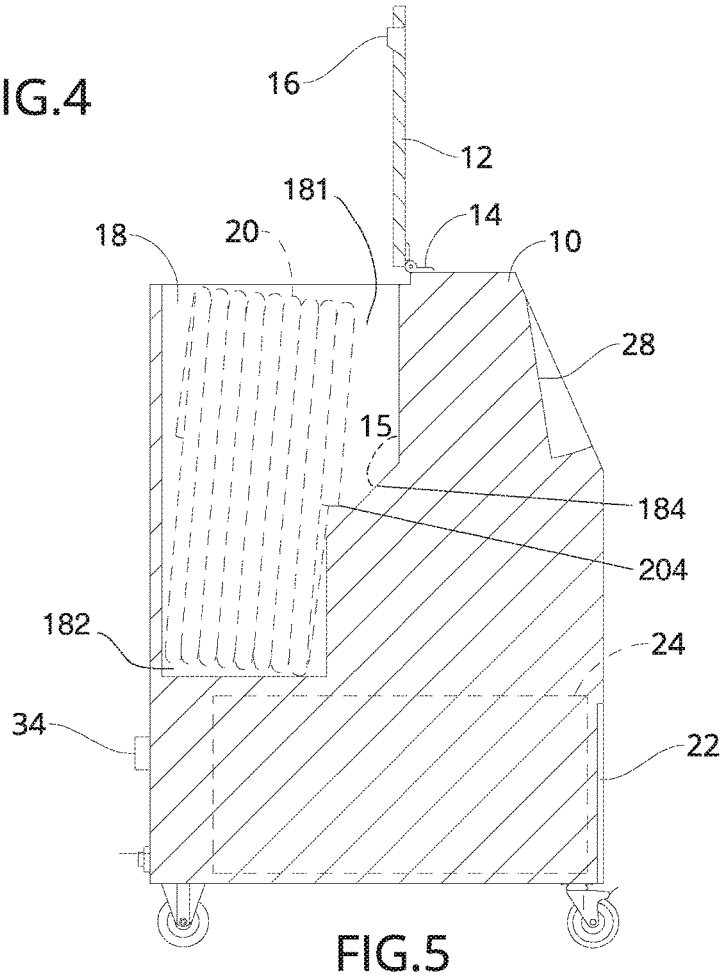
FIG. 5 is a section view of an exemplary embodiment of the present invention, taken along lines 5-5 in FIG. 4, with a hose kit 20 shown in hidden lines and internal components not shown for clarity, illustrating the transition shelf having a transition angle 15 relative the rear wall of the upper portion, wherein the transition angle 15 is between one hundred and twenty degrees and one hundred and fifty degrees.
Figure 6:
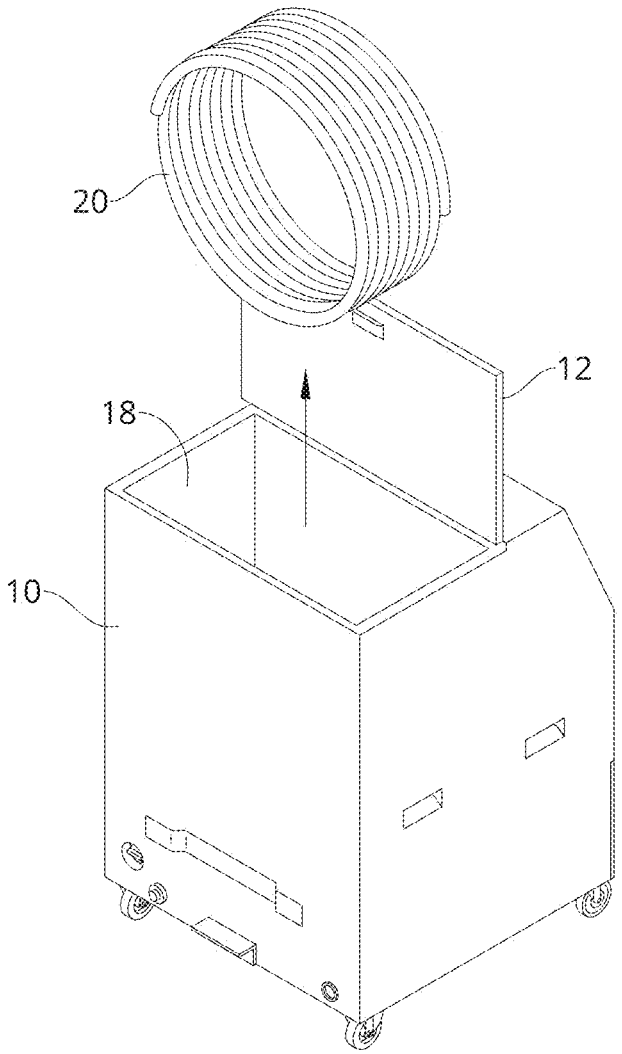
FIG. 6 is a rear perspective view of an exemplary embodiment of the present invention, showing the removal of the hose kit 20 from compartment 18.

The hose compartment 18 may have two portions, an upper portion 181 and a lower portion 182. The upper portion 181 communicates with the opening defined and occupied by the lid 12 in the closed condition. The upper portion 181 and lower portion 182 may have a shared width, wherein the width is defined along an x-axis that runs parallel with a longitudinal axis of the cord hook 34 as it is shown in FIG. 2. A z-axis extends from the wheel to the lid 12 and is perpendicular to the x-axis. A y-axis is parallel to both the x-axis and the z-axis, and so the y-axis defines a depth of the hose compartment 18. The upper portion 181 has a greater depth than the lower portion 182 because of a transition portion 184 that defines a tapered shelf underneath an end portion 204 of the hose kit 20 that occupies the hose compartment 18 in a wound condition, as illustrated in FIG. 5. The end portion 204, of the wound hose kit 20, occupies the space between the transition portion/shelf 184 and the upper portion 181. The transition shelf 184 may have an angle that ranges between thirty degrees and sixty degrees and may extend between twenty-five to forty percent of the depth of the upper portion 181. A midpoint of the transition shelf 184 may be disposed between forty and sixty percent along the shared height (defined by the z-axis) of the upper and lower portions 181 and 182.

Using the present invention would provide a straightforward and convenient solution for users seeking portable water-cooled air conditioners coupled with an integrated storage solution for the hose kit. To begin, users simply place the water-cooled portable air conditioner in their desired location within reach of a power outlet, after placement of the unit, the user will open the storage pocket compartment by pulling up on the hinged lid to access the hose kit inside. Once the hose kit is accessed it can be attached to a water connection for operation. Once set up, the user can easily initiate cooling operations by activating the unit through the controls of the control panel on the housing/body and adjusting settings such as temperature, fan speed, and airflow direction to suit their preferences. The internal components housed within the unit, including the compressor, condenser, and fan, work harmoniously to cool the air and distribute it throughout the room. When the hose kit is not in use, it can be conveniently stored in the specially designed storage pocket/compartment located within the housing/body. Opening the hinged lid of the hose compartment grants access to the space for storing the hose kit securely. Users can then close the hinged lid to cover the storage compartment, providing protection against water, dust, debris, and potential damage. This hinged design allows for effortless opening and closing of the compartment, ensuring convenient access to the hose kit whenever needed. During transportation or storage, users can rest assured that the hose kit remains securely stored within the compartment, minimizing the risk of loss or damage. Overall, by following these steps, users can effectively utilize the water-cooled portable air conditioner while enjoying the added convenience and practicality of its integrated storage solution for the hose kit.

The present invention can be used wherever an integrated storage pocket would facilitate storing a hose kit for the associated unit's purpose. Therefore, the present invention would be a boon for air conditioners based on evaporative cooling, wherein evaporative cooling is the conversion of liquid water into vapor using thermal energy in the air, resulting in a lower air temperature.

The disclosure could also be used as a general storage compartment for small tools, extension cords, or user manuals.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A portable water-cooled air condition unit comprising:
- a body defining an enclosure with an internal compartment;
- the internal compartment comprising:
  - a hose kit;
  - an upper portion communicating with an opening associated with a lid in the closed condition;
  - a lower portion having a lower depth approximately two-thirds that of an upper depth of the upper portion; and
  - a transition shelf interconnecting rear walls of the upper and lower portions, wherein the rear walls define a rearmost barrier of the upper and lower portions and so the upper and lower depths, respectively, and wherein the transition shelf is angled and configured to be disposed underneath an end portion of the hose kit in a wound condition housed in the internal compartment;
- the lid pivotably connected to the body to move between an open condition and a closed condition preventing access to the internal compartment;
- an equipment space housing at least one of a condenser or a compressor, wherein the equipment space is below the internal compartment.

2. The portable water-cooled air condition unit of claim 1, wherein the transition shelf has a transition angle relative the rear wall of the upper portion, wherein the transition angle is between one hundred and twenty degrees and one hundred and fifty degrees.

3. The portable water-cooled air condition unit of claim 2, wherein a midpoint of the transition shelf is disposed between forty and sixty percent of a distance defined by said opening and a lowest portion of the lower portion.

4. The portable water-cooled air condition unit of claim 3, wherein the body defines a space physically separated from the internal compartment, wherein the space houses one or more pump components.

* * * * *